US008109244B1

(12) United States Patent
Waissi

(10) Patent No.: US 8,109,244 B1
(45) Date of Patent: Feb. 7, 2012

(54) CRANKDISK BEARING ALTERNATIVES FOR THE WAISSI TYPE OPPOSED PISTON INTERNAL COMBUSTION ENGINE

(76) Inventor: Gary Ray Robert Waissi, Phoenix, AZ (US)

( * ) Notice: Subject to any disclaimer, the term of this patent is extended or adjusted under 35 U.S.C. 154(b) by 0 days.

(21) Appl. No.: 13/081,968

(22) Filed: Apr. 7, 2011

Related U.S. Application Data

(63) Continuation of application No. 12/943,898, filed on Nov. 10, 2010.

(51) Int. Cl.
*F02B 75/24* (2006.01)

(52) U.S. Cl. ..... 123/55.3; 123/197.4

(58) Field of Classification Search ..... 123/55.3, 123/197.4; 74/48–51, 54, 55, 567, 568 R, 74/570.3; 384/11, 50, 58
See application file for complete search history.

(56) References Cited

U.S. PATENT DOCUMENTS 3,386,429 A * 6/1968 Trammell, Jr. ..... 123/197.1
5,402,755 A 4/1995 Waissi

OTHER PUBLICATIONS

Waissi, Gary R., Internal Combustion (IC) Engine with Minimum Number of Moving Parts, Paper No. 950090, Futuristic Concepts in Engines and Components, 1995, pp. 61-64, SAE SP-1108. Published by SAE, United States.

* cited by examiner

*Primary Examiner* — Noah Kamen

(57) ABSTRACT

An improvement to the Waissi type opposed piston internal combustion engine is proposed. The engine has at least one pair of aligned and opposed cylinders with one reciprocating double-headed piston assembly in each cylinder pair. The reciprocating motion of the piston is transmitted to the driveshaft by a rotating crankdisk, which is rigidly and off-centered mounted to the driveshaft. The high friction metal to metal contact between the crankdisk and the piston contact wall is replaced by a combination of a roll resistance and friction under hydrodynamic conditions resulting to a significantly reduced total resistance between the piston and the crankdisk. This is accomplished by utilizing a bearing ring assembly slidably installed on the annular perimeter surface of the crankdisk. When the crankdisk rotates the bearing ring is held in place by U-profile flanges, which are either part of the bearing ring or part of the crankdisk. Alternatively, the bearing ring is replaced by a roller bearing or ball bearing.

3 Claims, 3 Drawing Sheets

CRANKDISK BEARING ALTERNATIVES FOR THE WAISSI TYPE OPPOSED PISTON INTERNAL COMBUSTION ENGINE

CROSS-REFERENCE TO RELATED APPLICATIONS

Continuation of application Ser. No. 12/943,898 of Nov. 10, 2010.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISK APPENDIX

Not Applicable.

CROSS-REFERENCE TO RELATED PATENTS

U.S. Pat. No. 5,402,755 of Apr. 4, 1995.

REFERENCES CITED

U.S. Patent Documents

U.S. Pat. No. 5,402,755 April 1995 Waissi 123/55

JOURNAL ARTICLES

Waissi, Gary R., Internal Combustion (IC) Engine with Minimum Number of Moving Parts, Paper No. 950090, Futuristic Concepts in Engines and Components, SAE SP-1108, pp. 61-64, (1995).

FIELD OF THE INVENTION

This invention relates to an internal combustion (IC) engine, and more particularly to the prior art reciprocating IC engine with opposed and aligned cylinders proposed by Waissi, U.S. Pat. No. 5,402,755, and its improvement as disclosed in SAE SP-1108 paper No. 950090. This is a Continuation of application Ser. No. 12/943,898 of Nov. 10, 2010.

BACKGROUND OF THE INVENTION

The prior art engine (U.S. Pat. No. 5,402,755), proposed by Waissi, is an internal combustion engine with opposed and aligned cylinders, called here the Waissi Engine. The Waissi Engine consists of at least one pair of aligned and opposed cylinders wherein a reciprocating double-headed piston is slidably mounted, and in which the double-headed piston axis intersects perpendicularly with the axis of a driveshaft. The reciprocating motion of the double-headed piston is transmitted to the driveshaft by a rotating crankdisk. The crankdisk is rigidly and off-centered mounted to the driveshaft, which is rotably mounted to a crankcase. The double-headed piston has two slots perpendicularly through its axis, one of which is to allow for a rotating movement of the crankdisk, and the other, to allow for the rotation of the driveshaft. The prior art further discloses that the double headed piston may be assembled from multiple components or parts. The lubrication between the piston slot bearing surface and the crankdisk outer perimeter bearing surface of the Waissi Engine is by oil splash. This arrangement allows metal to metal contact resulting into high unacceptable friction between the piston slot wall bearing surfaces and the crankdisk outer annular bearing surface. The crankdisk outer perimeter forms a circle.

In conventional prior art engines (V-, in-line, opposed) the metal to metal contact between the piston connecting-rod big-end and the crankshaft is avoided by creating hydrodynamic lubrication conditions in an oil film of the connecting-rod to crankshaft bearing. It is therefore, and in order to reduce friction and wear, highly desirable to create similar hydrodynamic lubrication conditions in the piston to crankdisk contact surface of the Waissi Engine, and, in particular, to provide for crankdisk rotation under hydrodynamic conditions.

The prior art improvement (SAE SP-1108, Paper No. 950090, Futuristic Concepts in Engines and Components, pp. 61-64, (1995)) to the Waissi Engine proposes to reduce friction between the crankdisk annular bearing surface and piston internal bearing surfaces by a special bearing ring. Within this improvement the outer perimeter surface of the crankdisk acts as a bearing and slides inside the bearing ring. The crankdisk has a diameter and annular perimeter design that fits tightly but slidably inside the bearing ring. The bearing ring, with a diameter that fits in-between the piston slot bearing surfaces (or inside the piston slot), is intended to roll or slide on the piston bearing surface. The crankdisk perimeter and surface design correspond the conventional engine crankshaft—piston rod journal design to provide for hydrodynamic lubrication.

However, as summarized above, while the prior art addresses the crankdisk perimeter and surface design and need for providing for hydrodynamic conditions, the prior art clearly fails to describe the required design of the bearing ring for the Waissi Engine such that the design would provide for a possible and feasible assembly, that the assembled bearing ring would stay in its designed place when the crankdisk rotates, and that the assembled bearing ring would provide for improved hydrodynamic conditions, and thereby would reduce friction and wear to aid the crankdisk movement. The prior art does also not address alternative crankdisk—piston assembly designs that utilize roller- or ball bearings in place of the above bearing ring.

BRIEF SUMMARY OF THE INVENTION

A main object of the present invention is to provide an improvement to the Waissi Engine to significantly lower the crankdisk to piston contact surface friction. This friction can be lowered by providing hydrodynamic lubrication conditions for the crankdisk to piston engagement via a bearing ring, or by adding a dedicated bearing (for example a roller-, or ball bearing) to transmit the engagement of the crankdisk and the piston. The invention comprises the features hereinafter described and particularly pointed out in the claims. The following description and the attached drawings set forth in detail certain illustrative, however indicative, embodiment of the invention, of but a few ways in which the principles of the invention may be employed.

The main object of this invention has been accomplished by a bearing ring with a cross-sectional shape of a U-profile, in which the U-profile sides (or flanges) face inward toward the center of the bearing ring, in which the surface of the base of the bearing ring is flat and smooth, corresponding to prior art bearing surface design, on both sides and parallel to the crankdisk bearing surface. The bearing ring is assembled preferably from two or three parts to make the bearing ring-crankdisk assembly possible. Within the proposed design the outer perimeter of the assembled bearing ring rolls on the piston slot wall, and the U-profile inner perimeter of the bearing ring fits tightly but slidably over the crankdisk perimeter surface. When the crankdisk rotates the bearing ring slides under hydrodynamic conditions on the crankdisk perimeter surface, and the U-profile flanges of the bearing ring hold the bearing ring in its designed position.

An alternative design of the bearing ring-crankdisk combination consists of cutting or casting (depending on materials chosen) a groove or depression along the center of the outer perimeter surface of the crankdisk with flanges on both sides of the groove or depression. Within this design a flat I-profile circular bearing ring is installed into the groove or depression, which holds the bearing ring in position when the crankdisk rotates.

Another alternative design consists of using a roller bearing or ball bearing instead of a bearing ring. Within this alternative the roller- or ball bearing is mounted on the crankdisk, and the outer perimeter of the roller- or ball bearing engages the piston.

By this arrangement; first, the design of the U-profile or flanged bearing ring consisting of two or three parts makes assembly of the crankdisk-bearing ring combination possible, or alternatively a groove or depression machine cut or cast into the outer perimeter surface of the crankdisk with a flat bearing ring installed into the groove or depression; second, the flanges of the bearing ring U-profile, or alternatively a groove or depression machine cut or cast into the outer perimeter surface of the crankdisk for the flat bearing ring, will keep the bearing ring in its designed position when the crankdisk rotates; third, the direct high friction metal to metal contact between the crankdisk perimeter bearing surface and the piston slot wall is replaced by a combination of a roll resistance, between the bearing ring outer perimeter and the piston, and friction under hydrodynamic conditions, between the bearing ring inner perimeter and the crankdisk, resulting to a significantly reduced overall friction between the piston and the crankdisk; fourth, improved hydrodynamic lubrication conditions are made possible by using a U-profile (or flanged profile) for the bearing ring design, in which the U-profile sides (or flanges) face inward toward the center of the bearing ring, or alternatively machining a U-profile groove or casting a U-profile depression into the outer perimeter surface of the crankdisk for the bearing ring, and thereby blocking or reducing oil seepage from between the crankdisk outer perimeter and bearing ring. Finally, if the bearing ring is substituted by a roller bearing or ball bearing, hydrodynamic conditions are not created, but the crankdisk to piston friction will be significantly reduced.

BRIEF DESCRIPTION OF THE SEVERAL VIEWS OF THE DRAWINGS

The main object, features and advantages of this invention will become apparent from a consideration of the following description, the appended claims and the accompanying drawings in which:

Figure 1:
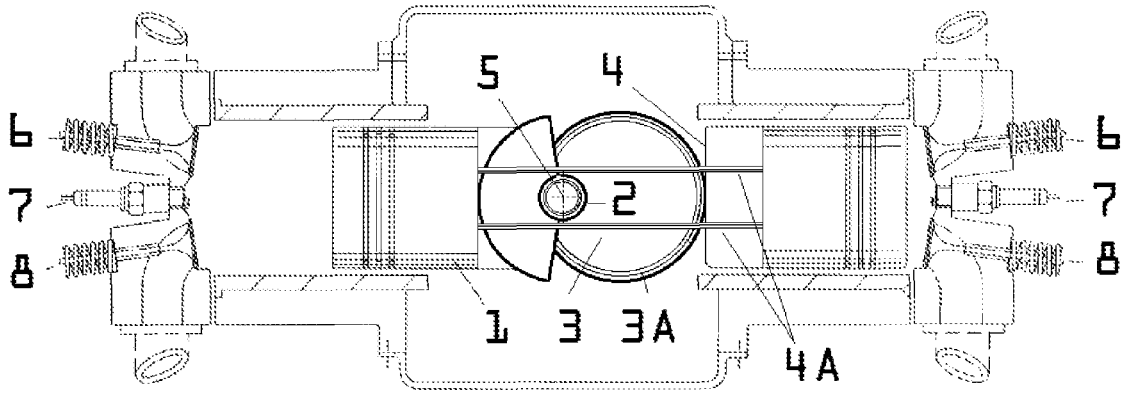
FIG. 1 (adapted from U.S. Pat. No. 5,402,755 and from SAE SP-1108, Paper No. 950090, Futuristic Concepts in Engines and Components, pp. 61-64, (1995)) is a section view of the Waissi Engine, in which a double-headed piston 1 reciprocates, perpendicularly to a driveshaft 2, in aligned and horizontally opposed cylinders. The rigid double-headed piston assembly consists of two piston heads attached to each other by four connecting members 4A (two of those are shown in FIG. 1). These four connecting members can be, for example, bolts. The connecting members provide two slots perpendicularly through the axis of the pistons, one of which is to allow for a rotating movement of the crankdisk 3 and the bearing ring 3A combination, and the other slot, to allow for the rotation of the driveshaft 2. Other parts and components are not shown for clarity.
Figure 2A:
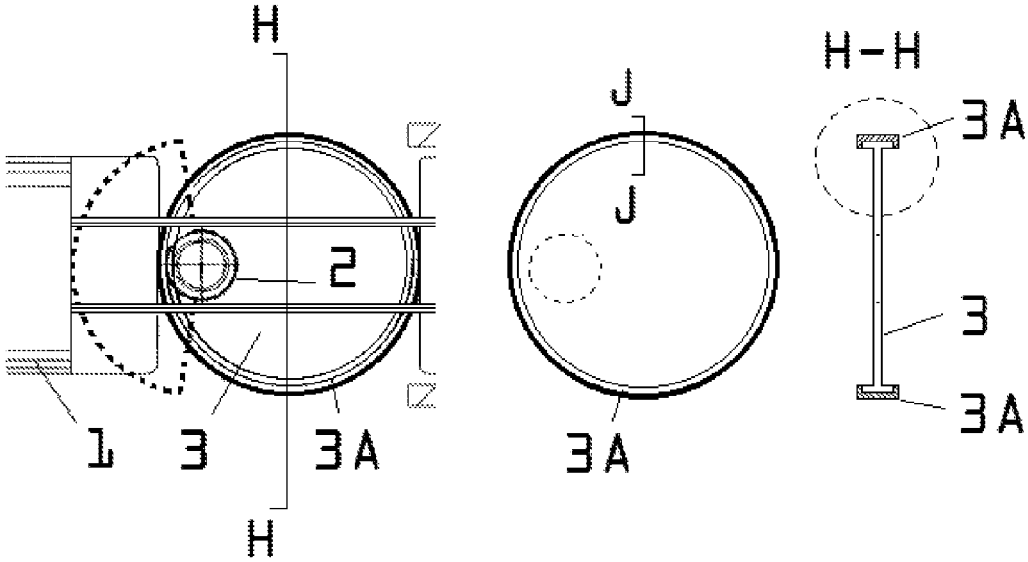
FIG. 2*a* shows the center section of the engine of FIG. 1, then separately and for clarity the bearing ring 3A only, as well as the cross section H-H of the crankdisk 3—bearing ring 3A assembly. Other parts and components are not shown for clarity.
Figure 2B:
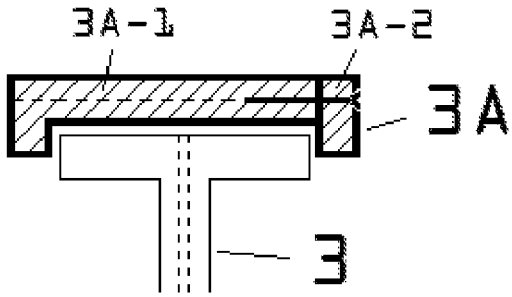
FIG. 2*b* shows three possible alternative designs, FIG. 2*b*-1, FIG. 2*b*-2, FIG. 2*b*-3, for the bearing ring cross section; enlarged section J-J of FIG. 2*a* (the lower end of the bearing ring-crankdisk assembly is not shown for clarity).
Figure 2B:
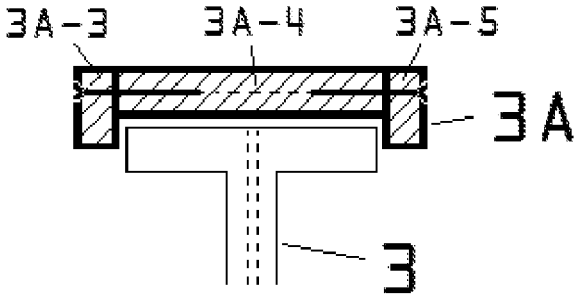
Figure 2B:
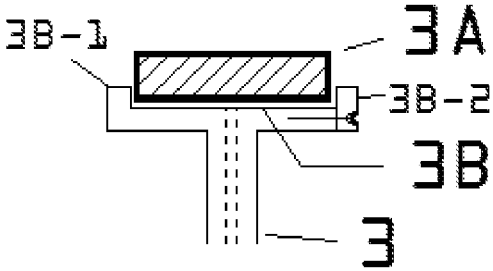

First, in FIG. 2*b*-1, a two component (3A-1, 3A-2) U-profile (or flanged profile) bearing ring design assembly, cross section J-J detail, in which part 3A-1 forms the bearing ring cross-section L-shaped profile (bearing ring cross-section one side and base, or a bearing ring with a flange on one-side with the flange facing inward toward the center of the bearing ring), and 3A-2 the bearing ring cross-section flat I-shaped profile ring flange. The oil supply channel is shown as two parallel dashed lines in the crankdisk cross-section.

Second, in FIG. 2*b*-2, as an alternative design, a three component (3A-3, 3A-4, 3A-5) U-profile bearing ring design assembly, cross section J-J detail, in which parts 3A-3 and 3A-5 are flat I-profile rings (3A-3 and 3A-5 are flanges only), and form the sides of the bearing ring assembly, and part 3A-4, also a flat I-profile, forms the base of the bearing ring U-profile. Clearly, part 3A-3, in FIG. 2*b* the left hand side flange of which is approximately perpendicular to part 3A-5, in FIG. 2*b* the right hand side flange of the bearing ring. The oil supply channel is shown as two parallel dashed lines in the crankdisk 3 cross-section.

Third, in FIG. 2*b*-3, as another alternative, a one component flat bearing ring 3A design, cross section J-J detail, is shown, in which a groove or depression 3B, with flanges 3B-1 and 3B-2 extend outward away from the center of the crankdisk, has been created (for example, depending on material used for the crankdisk, machine cut or cast) into the outer perimeter surface of the crankdisk. Within this design, in order to be able to install the bearing ring, the flange (for example 3B-2) on one side of the groove is removable. The oil supply channel is shown as two parallel dashed lines in the crankdisk cross-section. Other parts and components are not shown for clarity.

DETAILED DESCRIPTION OF THE INVENTION

In FIG. 1 (adapted from U.S. Pat. No. 5,402,755 and from SAE SP-1108, Paper No. 950090, Futuristic Concepts in Engines and Components, pp. 61-64, (1995)) the double-headed piston 1 reciprocates, perpendicularly to the driveshaft 2, in the aligned and horizontally opposed cylinders. The driveshaft 2 is rotably mounted to the crankcase. The center axis 5 of the driveshaft is the center of rotation of the driveshaft. The crankdisk 3 is rigidly and off-centered attached to the driveshaft 2. The crankdisk 3 is located at the piston axis.

The outer perimeter surface of the crankdisk 3 acts as a bearing and slides under hydrodynamic conditions inside a bearing ring 3A, which rolls on the surface of the piston slot 4A end wall 4 provided axially through the piston 1. Hydrodynamic conditions are created by oil being pumped under pressure through channels or cavities provided through the crankdisk connecting the center of the driveshaft oil supply to the outer perimeter bearing surface of the crankdisk.

To force rolling of the bearing ring on the surface of the piston slot wall 4 the outer perimeter surface of the bearing ring 3A, and the piston slot wall 4, may be provided with appropriate toothing or gear. This, forced rolling of the bearing ring via toothing or gear, however, is not necessary, does not provide for additional benefits, and does not constitute a different invention.

The crankdisk 3 has a diameter that fits tightly but slidably inside the bearing ring 3A, which fits tightly inside the piston slot between the piston bearing surfaces. The crankdisk 3 has a perimeter design, known from the prior art, that provides for hydrodynamic lubrication conditions between the crankdisk 3 and the bearing ring 3A. The piston slot length is such that it will accommodate the crankdisk 3 and the bearing ring 3A including an acceptable tolerance known from the prior art.

In the preferred embodiment the bearing ring, with a U-profile cross-section, in which the U-profile sides (or flanges) face toward the bearing ring 3A center, is assembled of two or three parts as shown in FIG. 2*a* and FIG. 2*b*. The proposed designs have the following benefits respectively: shown designs (FIG. 2*a* and FIG. 2*b*-1 and FIG. 2*b*-2) make the assembly of the crankdisk-bearing ring combination possible, shown designs (FIG. 2*a* and FIG. 2*b*-1 and FIG. 2*b*-2) provide means for holding the bearing ring in place when the crankdisk rotates, as well as, shown designs (FIG. 2*a* and FIG. 2*b*-1 and FIG. 2*b*-2), because of the flanges, provide means for reducing oil seepage from between the bearing ring and the crankdisk bearing surface creating and improving hydrodynamic conditions, and thereby reducing friction.

An alternative preferred embodiment is provided by a simple flat I-profile for the bearing ring 3A (FIG. 2*b*), for which a U-profile groove or depression has been created (for example, depending on material used for the crankdisk, machined or cut, or created as part of the casting process) onto the outer perimeter surface of the crankdisk 3. The bearing ring 3A is installed into this groove or depression. In this case (see FIG. 2*b*-3) one of the crandkdisk flanges is removable to allow for the bearing ring installation. The proposed design has the following benefits: the design (FIG. 2*b*-3) make the assembly of the crankdisk-bearing ring combination possible, the design (FIG. 2*b*-3) provide means for holding the bearing ring in place when the crankdisk rotates, as well as, the design (FIG. 2*b*-3), because of the flanges on the crankdisk outer perimeter surface, provide means for reducing oil seepage from between the bearing ring and the crankdisk bearing surface creating and improving hydrodynamic conditions, and thereby reducing friction.

Without loss of generality, different angles of the U-profile sides (or flanges) to the bearing ring base, or different side- or flange designs (for example grooves, depressions, or notches added to the flanges) either as part of the bearing ring or the crankdisk do not change the bearing ring function, and, therefore, do not constitute a different invention.

For clarity and simplicity, significant engine parts are shown in FIG. 1, FIG. 2*a* and FIG. 2*b* only.

It is appreciated that the proposed bearing ring assembly can be replaced by a ball bearing or roller bearing, which constitutes a significant difference from the prior art for the Waissi engine. This arrangement is not shown in the Figures.

Further, it is appreciated from the FIG. 1, FIG. 2*a* and FIG. 2*b* and the above description summarily that according to the present invention, since the crankdisk 3 slides under hydrodynamic conditions inside the bearing ring 3A, which rolls against the piston slot wall 4, metal to metal high friction contact between the crankdisk and the piston slot wall is avoided with the proposed improvements. While a bearing ring has been proposed in the referenced prior art, specific designs and requirements as presented above and in FIG. 2*a* and FIG. 2*b* have not been proposed for the Waissi Engine. The proposed design of the bearing ring and bearing ring assembly with respect to assembly of the crankdisk-bearing ring combination, function of the bearing in terms of the bearing ring staying in its designed position when the crankdisk rotates, as well as reduction of oil (or other type of lubricant) seepage due to the proposed designs to improve hydrodynamic conditions, summarily constitute a significant difference from the prior art for the Waissi Engine.

A bearing ring 3A substitution or replacement by other types of bearings or bearing rings which accomplish the same function do not constitute a different invention. With respect to assembly, bearing weight, dynamic engine balance, wear and tear, cost of bearings, and total cost of engine manufacture, the proposed solutions appear to be the simplest, most durable, and most cost effective.

What is claimed is:

1. An improved internal combustion engine, comprising: a driveshaft and means mounting the driveshaft for rotation about an axis; at least one pair of aligned and opposed cylinders; at least one double-headed piston, having at least one rigid connection between the piston heads, reciprocating in said pair of cylinders; a circular crankdisk, one for each said piston respectively, having an outer annular surface formed about a center that is laterally offset from the center of rotation of the driveshaft, and rigidly attached to the said driveshaft; the said piston body having a first slot, a second slot perpendicular to the first slot, each of said slots being perpendicular to the axis of the driveshaft and the crankdisk, the first slot being perpendicular to the piston axis and allowing the rotating movement of the driveshaft, and the second slot allowing the rotating movement of the crankdisk;

wherein the improvement comprises of a bearing ring, mounted on the outer annular surface of the crankdisk, which engages slidably under hydrodynamic conditions the annular surface of said crankdisk, and rolls or slides against the inside walls of a slot provided axially through the double-headed piston, in which the said bearing ring design has a U-profile cross-section, or two-sided flanged cross-section, with flanges facing toward the center of the bearing ring;

wherein the said bearing ring consists of parts or components to allow for the crankdisk-bearing ring combination assembly;

wherein the said bearing ring diameter and sides of the U-profile (or flanges) fit tightly but slidably against the outer perimeter and outer perimeter sides of the crankdisk to keep the bearing ring in its designed place when the crankdisk rotates;

wherein the sides, or flanges, of the said bearing ring U-profile, serve the additional purpose of blocking or reducing oil seepage from between the bearing ring and the crankdisk when the crankdisk rotates;

whereby the said crankdisk with the aid of the said bearing ring transmits the piston force of the double-headed piston to the driveshaft and causes the driveshaft to rotate about its axis.

2. An improved internal combustion engine, comprising: a driveshaft and means mounting the driveshaft for rotation about an axis; at least one pair of aligned and opposed cylinders; at least one double-headed piston, having at least one rigid connection between the piston heads, reciprocating in said pair of cylinders; a circular crankdisk, one for each said piston respectively, having an outer annular surface formed about a center that is laterally offset from the center of rotation of the driveshaft, and rigidly attached to the said driveshaft; the said piston body having a first slot, a second slot perpendicular to the first slot, each of said slots being perpendicular to the axis of the driveshaft and the crankdisk, the first slot being perpendicular to the piston axis and allowing the rotating movement of the driveshaft, and the second slot allowing the rotating movement of the crankdisk;

wherein the improvement comprises of a bearing ring, mounted on the outer annular surface of the crankdisk, which engages slidably under hydrodynamic conditions the annular surface of said crankdisk, and rolls or slides against the inside walls of a slot provided axially through the double-headed piston, in which the bearing ring design has a simple flat I-profile cross-section, and no flanges, in which a U-profile flanged groove or depression has been created, for example by machining or as part of a casting process depending on materials chosen, onto the outer perimeter surface of the said crankdisk;

wherein the said crankdisk consists of parts or components to allow for the crankdisk-bearing ring combination assembly;

wherein the said bearing ring diameter fits tightly but slidably on the outer perimeter surface of the said crankdisk groove or depression and in-between the crankdisk U-profile flanges to keep the said bearing ring in its designed place when the said crankdisk rotates;

wherein the sides, or flanges, of the said crankdisk U-profile, serve the additional purpose of blocking or reducing oil seepage from between the said bearing ring and the said crankdisk when the said crankdisk rotates;

whereby the said crankdisk, with the aid of the said bearing ring transmits the piston force of the double-headed piston to the driveshaft and causes the driveshaft to rotate about its axis.

3. An improved internal combustion engine, comprising: a driveshaft and means mounting the driveshaft for rotation about an axis; at least one pair of aligned and opposed cylinders; at least one double-headed piston, having at least one rigid connection between the piston heads, reciprocating in said pair of cylinders; a circular crankdisk, one for each said piston respectively, having an outer annular surface formed about a center that is laterally offset from the center of rotation of the driveshaft, and rigidly attached to the said driveshaft; the said piston body having a first slot, a second slot perpendicular to the first slot, each of said slots being perpendicular to the axis of the driveshaft and the crankdisk, the first slot being perpendicular to the piston axis and allowing the rotating movement of the driveshaft, and the second slot allowing the rotating movement of the crankdisk;

wherein the improvement comprises of a roller bearing or ball bearing, mounted on the outer annular surface of the crankdisk, which engages the annular surface of said crankdisk, and rolls or slides against the inside walls of a slot provided axially through the double-headed piston;

whereby the said crankdisk, with the aid of the said roller bearing or ball bearing transmits the piston force of the double-headed piston to the driveshaft and causes the driveshaft to rotate about its axis.

* * * * *